US008720069B2

(12) United States Patent
Iwashita

(10) Patent No.: US 8,720,069 B2
(45) Date of Patent: May 13, 2014

(54) RECIPROCATING ELECTRIC SHAVER

(75) Inventor: Seiji Iwashita, Matsumoto (JP)

(73) Assignee: Izumi Products Company, Nagano (JP)

( * ) Notice: Subject to any disclaimer, the term of this patent is extended or adjusted under 35 U.S.C. 154(b) by 690 days.

(21) Appl. No.: 12/799,303

(22) Filed: Apr. 22, 2010

(65) Prior Publication Data

US 2010/0269350 A1 Oct. 28, 2010

(30) Foreign Application Priority Data

Apr. 23, 2009 (JP) ..... 2009-104740

(51) Int. Cl.
*B26B 19/02* (2006.01)

(52) U.S. Cl.
USPC ..... 30/43.92; 30/346.51

(58) Field of Classification Search
USPC ..... 30/43.92, 34.1, 43.91, 346.51, 43.7
See application file for complete search history.

(56) References Cited

U.S. PATENT DOCUMENTS

| | | | | |
|---|---|---|---|---|
| 5,012,147 | A * | 4/1991 | Bertram et al. | 310/80 |
| 5,410,811 | A * | 5/1995 | Wolf et al. | 30/43.9 |
| 5,414,930 | A * | 5/1995 | Muller et al. | 30/43.3 |
| 5,685,077 | A * | 11/1997 | Mukai et al. | 30/43.92 |
| 5,946,806 | A * | 9/1999 | Watanabe et al. | 30/43.92 |
| 5,953,825 | A * | 9/1999 | Christman et al. | 30/527 |
| 6,098,289 | A | 8/2000 | Wetzel et al. | |
| 6,226,871 | B1 * | 5/2001 | Eichhorn et al. | 30/43.92 |
| 6,559,563 | B1 * | 5/2003 | Shimizu et al. | 310/12.19 |
| 7,607,229 | B2 * | 10/2009 | Motohashi et al. | 30/43.7 |
| 8,141,253 | B2 * | 3/2012 | Royle | 30/34.05 |
| 2002/0108251 | A1 * | 8/2002 | Brum et al. | 30/43.7 |
| 2003/0167638 | A1 * | 9/2003 | Bader et al. | 30/43.92 |
| 2004/0010919 | A1 * | 1/2004 | Shiba et al. | 30/43.92 |
| 2006/0265880 | A1 * | 11/2006 | Sagawa | 30/43.92 |
| 2007/0113409 | A1 * | 5/2007 | Schaaf | 30/43.92 |
| 2009/0056142 | A1 * | 3/2009 | Royle et al. | 30/43.7 |
| 2009/0165305 | A1 * | 7/2009 | Kraus et al. | 30/43.7 |
| 2012/0005899 | A1 * | 1/2012 | Takaoka et al. | 30/43.91 |

FOREIGN PATENT DOCUMENTS

| | | | |
|---|---|---|---|
| EP | 1 728 603 | A1 | 12/2006 |
| EP | 1 854 593 | A1 | 11/2007 |
| EP | 1 935 585 | A1 | 6/2008 |
| GB | 2 266 070 | A | 10/1993 |
| JP | H10-43443 | A | 2/1998 |
| JP | 3945376 | B | 7/2007 |
| WO | WO 2010/000352 | A2 | 1/2010 |

* cited by examiner

*Primary Examiner* — Omar Flores Sanchez
(74) *Attorney, Agent, or Firm* — DLA Piper LLP (US)

(57) ABSTRACT

A reciprocating electric shaver with a shaving unit which includes an outer cutter(s) an inner cutter(s), a motor, and a drive mechanism all formed into a single unit and is provided to make a pivot motion in left and right directions, the shaving unit being supported in the grip section of the shaver by a pair of pivot parts provided on the front and back sides of the motor, and the head part, which includes the outer cutter(s), the inner cutter(s), and the drive mechanism, being provided to pivot front and back with respect to the motor.

3 Claims, 8 Drawing Sheets

RECIPROCATING ELECTRIC SHAVER

BACKGROUND OF THE INVENTION

1. Field of the Invention

The present invention relates to a reciprocating electric shaver in which a shaving unit, which includes an outer cutter (s), an inner cutter(s), a motor, and a drive mechanism provided in a single unit, is held so as to pivot left and right (or sideways) in a grip section of the shaver.

2. Description of the Related Art

A reciprocating electric shaver in which a shaving unit, which includes an outer cutter(s), an inner cutter(s), a motor, and a drive mechanism that are provided in a single unit, is installed so as to be depressible in a grip section of the shaver that houses therein a power supply unit such as a battery is known publicly.

Japanese Patent No. 3945376 and Japanese Patent Application Laid-Open (Kokai) No. H10-43443 disclose shavers in which two upwardly urged lateral supporting arms are provided so that a shaving unit is moved up and down and tilted in left and right directions. For example, when the right side edge of the outer cutter(s) is pressed downward, the entire shaving unit tilts to the right side and pivots to the right side. Likewise, when the left side edge of the outer cutter(s) is pressed downward, the entire shaving unit is tilted to the left side.

In the shaver of the Japanese Patent Application Laid-Open (Kokai) No. H10-43443, the upper part of an outer cutter holder that holds two outer cutters is provided to pivot front and back on a pair of horizontal left and right pins, and two inner cutters are independently urged upward. In this structure, the two outer cutters are moved up and down following the front/back pivot motion of the outer cutter holder. In this shave, however, the inner cutter drive mechanism that reciprocates the inner cutters is provided on the motor side, and it is not provided so as to pivot together with the outer cutter holder.

In the conventional shavers described above, four supporting arms are urged upward by coil springs, and the shaving unit is set to be in contact with the upper edge of the supporting arms. Accordingly, the support structure of the shaving unit is complex since it includes the supporting arms, coil springs and the like, and as a result it has an increased number of parts, and there is a problem that the workability of assembling is poor.

For reciprocating electric shavers, it is desirable that the head part pivot not only to the left and right but also to pivot front and back, thus providing a good contact between the outer cutter(s) and the skin (shaved surface). The above-noted Japanese Patent Application Laid-Open (Kokai) No. H10-43443 discloses a structure in which the outer cutter holder pivots front and back. However, in this shaver, the inner cutter and the inner cutter drive mechanism are not pivotable front and back, and as a result, there is a problem that the outer cutter front and back pivot motion is not made smoothly.

BRIEF SUMMARY OF THE INVENTION

The present invention is created considering the above-described circumstances, and it is an object of the present invention to provide a reciprocating electric shaver in which a support structure that supports the shaving unit so as to pivot left and right is simple in which there is a decreased number of parts, in which the assembly workability is good, and furthermore, in which the head part front and back pivot motion is made smoothly and the closeness of contact with the skin is improved, upgrading the shaving quality.

The above object is accomplished by a unique structure of the present invention for a reciprocating electric shaver that includes a shaving unit in which a substantially semi-cylindrical, horizontal outer cutter(s), an inner cutter(s) that makes sliding contact with the inner surface of the outer cutter(s), a motor, and a drive mechanism that reciprocates the inner cutter using the motor are formed into a single unit, with said shaving unit being pivotable left and right; and in the present invention,

- the shaving unit is supported in a grip section of the shaver by a front/back pair of pivot parts that sandwich said motor from the front and back of the motor, and
- a head part that includes the outer cutter(s) and inner cutter (s) and the drive mechanism is provided so as to pivot front and back with respect to the motor.

In the present invention, the shaving unit is supported by the front/back pair of pivot parts that sandwiches the motor from the front and back. Accordingly, the structure for supporting the shaving unit is very simple, the number of parts is very low, and the assembly workability is very good. Also, since the head part that includes the outer cutter(s), the inner cutter(s), and the drive mechanism is provided so as to pivot front and back with respect to the motor, the head part front and back pivot motion is made smoothly, and close contact with the skin is increased, improving the quality of shaving.

One of the pivot parts that support the shaving unit can be provided on the inner surface of the grip section of the shaver; however, in such a structure, the workability is poor for performing assembly of the pivot part simultaneously with imposition of the grip section of the shaver. Accordingly, in the present invention, the grip section is divided into two to form a front casing and a back casing, and inside thereof, a motor holder is held in the front casing (or to be able to temporarily hold it) separately from a grip section casing, and the motor is sandwiched from the front and back by the motor holder and the front casing so that the motor is supported pivotably. With this structure, the shaving unit that has the motor is first brought to be sandwiched between the front casing and the motor holder as a preliminary assembly, and then the back casing is fixed to the front casing.

In the present invention, it is preferable to use springs that return the shaving unit to its erect position (return position). The installation of the spring is accomplished in the following manner: the motor holder is formed with an elongated window which is long in the horizontal direction and located below the pivot part, and the motor (or part that forms a single unit with the motor, e.g. a motor case) is formed with a projecting piece; the projecting piece of the motor (or a motor case with the motor therein) is brought into the elongated window of the motor holder, and then two coil springs that sandwiches this projecting piece from left and right is installed inside the elongated window. More specifically, in a state in which the pivot parts provided on the motor (or motor case) are sandwiched from the front and back by the motor holder, the motor holder is temporarily held in the front casing, coil springs are installed in the elongated window of the motor holder, and then, the back casing is brought to cover the motor, and then the front and back casings are fixed together. Accordingly, in the present invention, easy assembly of the shaver is assured; and when the front and back casings are fixed together, the motor holder and the back casing are also fixed together accordingly.

In the present invention, it is preferable that the head part that pivots front and back with respect to the motor be provided with a pivot case that can pivot front and back with respect to the motor; the drive mechanism be housed in this pivot case; and further, an outer cutter holder, which holds the outer cutter(s) so that the outer cutter(s) is movable up and down, and an inner cutter holder, which holds, while urging upward, the inner cutter be provided in the pivot case. In this structure, the entire head part that includes the drive mechanism is housed in the pivot case so as to pivot front and back; accordingly, the front and back pivot motion of the head part is made smoothly.

The above-described pivot case is, so as to pivot front and back, held on the left and right pair of supporting arms erected from the motor case, in which the motor is installed. To this supporting arms, wire springs are respectively fixed at their top portions, and the bottom portion of the wire springs are engaged with the pivot case. With this structure, the pivot case (i.e. the head part) can be returned to its return position. The supporting arms can be provided to erect on a member that forms a single unit with the motor case, such as a head bottom plate, for example.

Each of the wire springs is bent in, for example, a substantially inverted V-shape, and the center (the peak point) of the bent part is fixed to the supporting arm so that any rotation of the wire spring is restricted, and further the both leg (end) portions of the inverted V-shape wire spring, which are extended downward, are independently engaged with the pivot case. As a result, the coil springs have return capability to push the pivot case in the front and back direction. In this structure, the center part of the wire spring can be fixed to the supporting arm by having both leg portions pass through the front/back pair of small holes formed in the supporting arm and bent downward. In addition, the left/right pair of supporting arms are formed by leaf springs mutually urged in the lateral direction outwardly (opposing surface side), so that they can elastically hold the tower portions.

Conventionally, a torsion coil spring is used as a spring that returns the pivot case in the front/back direction, so that the coil part at the center of this coil spring is wound on a spring bearing boss provided on the supporting arms (see, for instance, Japanese Patent Application Laid-Open (Kokai) No. H06-335575). However, the coil part thickness of the coil springs increases according to the winding count of the spring member. Because of this, when such a coil springs are used, the gap between the supporting arms and the pivot case side supporting portion (tower portion) becomes larger, and this can cause the head part of the shaver to become larger. In addition, when such a coil spring is used, it is necessary to have both ends of the coil spring be latched in the elongated slots that pierce the pivot case and are provided on the main unit (grip or motor, motor case, head bottom plate); accordingly, it is necessary to use large size coil springs, and as a result, the structure becomes complex.

In contrast to this, in the present invention, instead of a torsion coil spring, a substantially inverted V-shaped wire spring is employed. Accordingly, it is possible to make the gap, which is for housing the wire spring, small (narrow), and it is also possible to make the head part of the shaver small. In addition, since both ends (leg portions) of the wire spring do not have to be latched to the main unit (grip section) of the shaver, it is possible to use small wire springs and to make the structure simple. The structure that uses this wire spring can also be applied to a structure in which the shaving unit is fixed to the grip section and only the head part can pivot front and back, and the same effects as noted above is obtained in such a structure.

In the present invention, the shaving unit is pivot-supported to pivot left and right with respect to the grip section of the shaver; therefore, to make the electric shaver have a water-proof structure, it is necessary to separately form a watertight seal for the motor of the shaving unit and for the power supply unit of the grip section. A structure in which the motor and power supply unit are separately sealed is disclosed in the above-noted Japanese Patent No. 3945376; however, this is a structure in which a linear motor sealed in advance is housed in a head part projecting from the grip section, and with the grip section having a front and back divided case, these front and back casing are joined together with a seal in between, and the power supply unit is housed inside the grip section. In comparison to this structure, in the present invention, the motor of the shaving unit is pivot-supported in the grip section; accordingly, if a sealing is made by the front and back casings, it would be necessary to perform an attachment of the seal member and an assembly of the pivot part simultaneously, and this makes the operability poor, and the water proofing reliability would be poor.

In light of this, the present invention takes such a structure that while the motor is installed water-tightly in the motor case, the power supply unit is installed water-tightly between the front casing of the grip section of the shaver and the inner cover that is fixed to the front casing. Because of this, the joint portion of the front and back casings is not required to be sealed, so that the ease of assembling the pivot part is improved, and the water proofing reliability is increased.

DETAILED DESCRIPTION OF THE INVENTION

Figure 1:
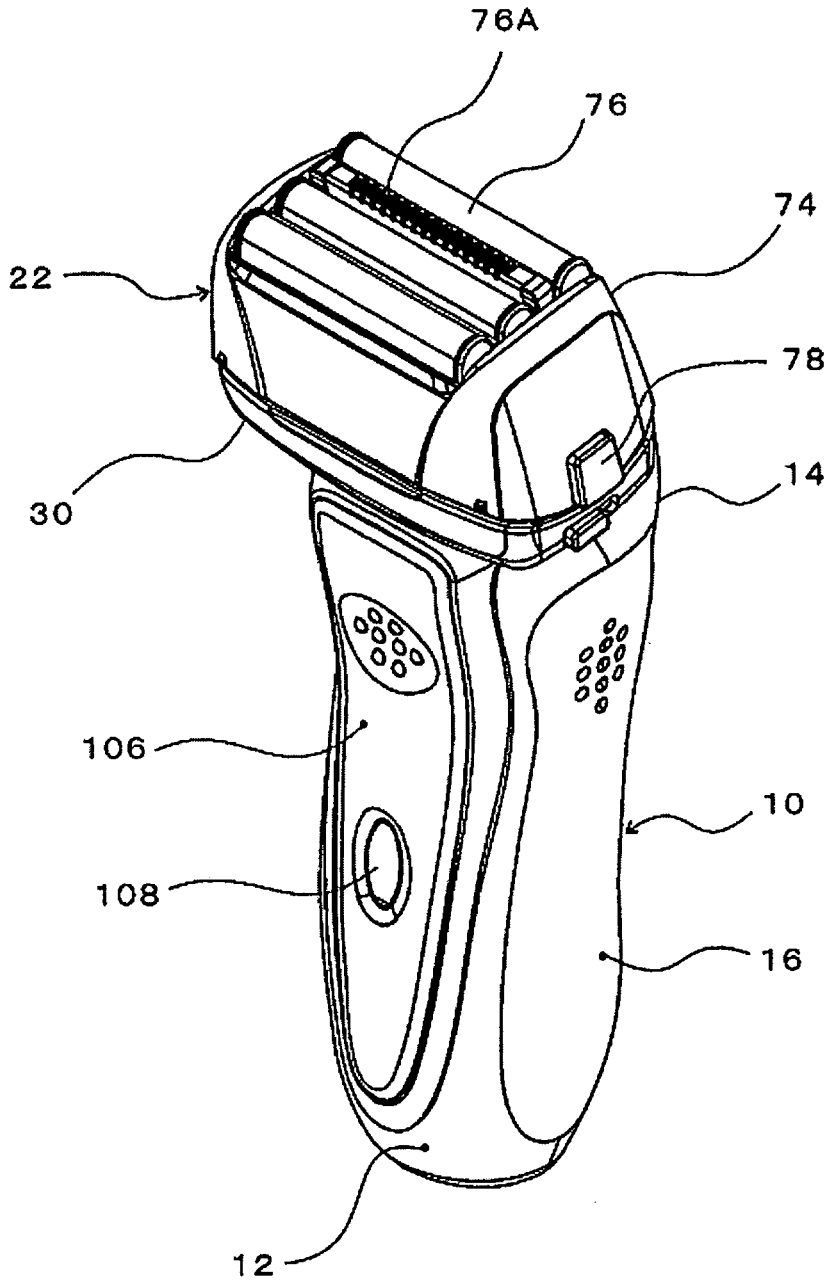
FIG. 1 is an external perspective view of one embodiment of an reciprocating electric shaver according to the present invention.
Figure 2:
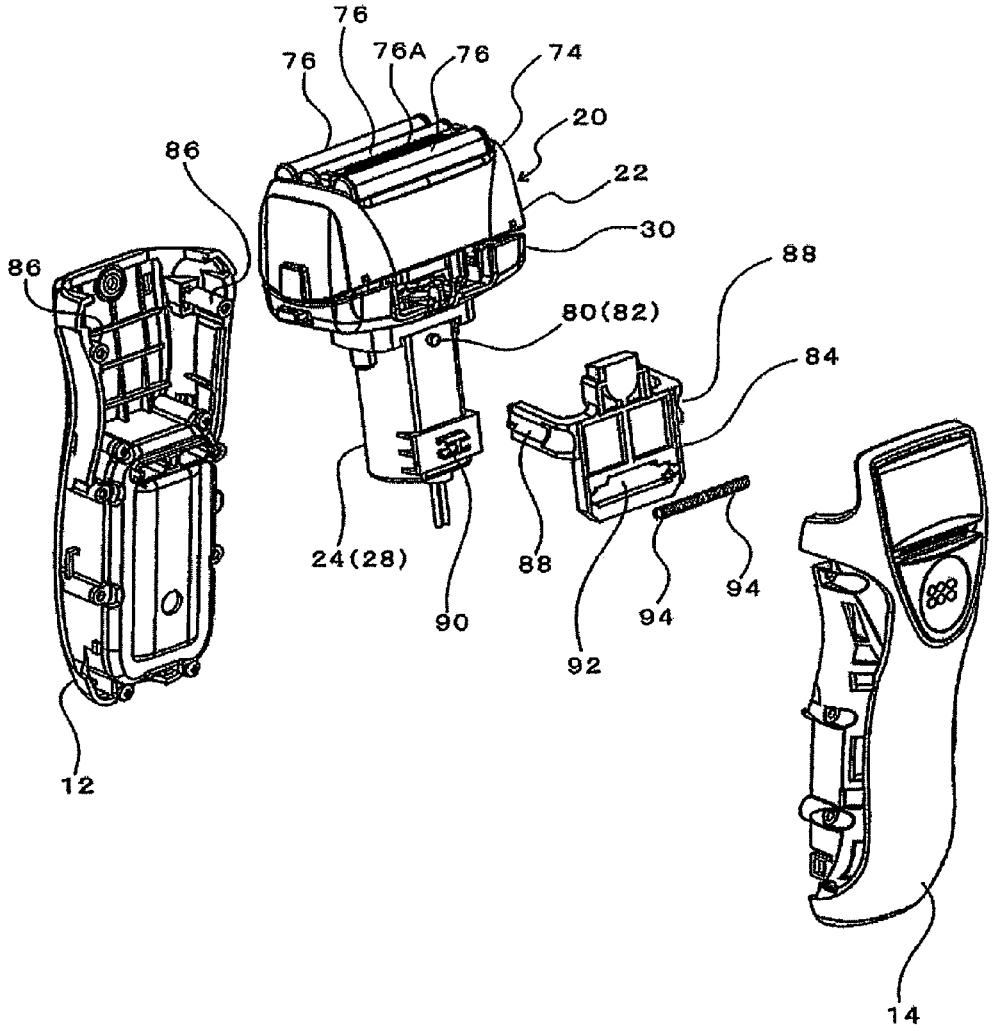
FIG. 2 is an exploded perspective view of the grip section of the shaver.
Figure 3:
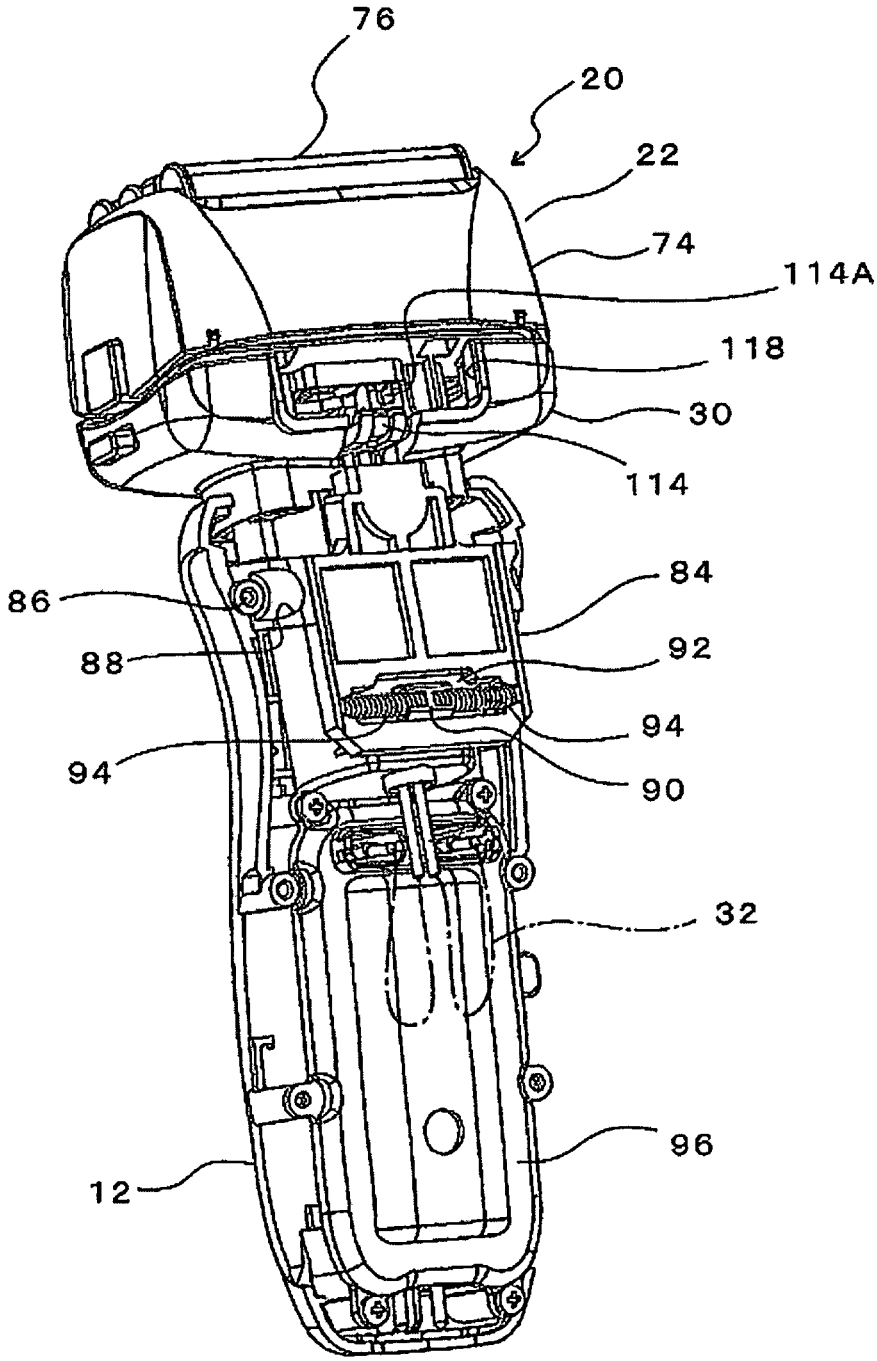
FIG. 3 is a perspective view of the internal structure of the shaver with the back casing of the grip section of the shaver removed.

In FIGS. 1 to 3, the reference numeral 10 is a grip section of the shaver, and this grip section is comprised of a substantially shell shaped front casing 12 and a substantially shell shaped back casing 14 that are joined and mated at their outer edges. More specifically, the front and back casings 12 and 14 are joined together with three screws (not illustrated) each along the left and right side edges. On the left and right side surfaces of the front and back casings 12 and 14, covers 16 (FIG. 1 shows only the right side cover 16) are fitted to hide the joining edges of the two casings, joining screws, and the like. A suitable number of engaging hooks (not illustrated) are formed integrally on the inner surfaces of the covers 16, and these engaging holes are engaged with the front and back casings 12 and 14.

Figure 5:
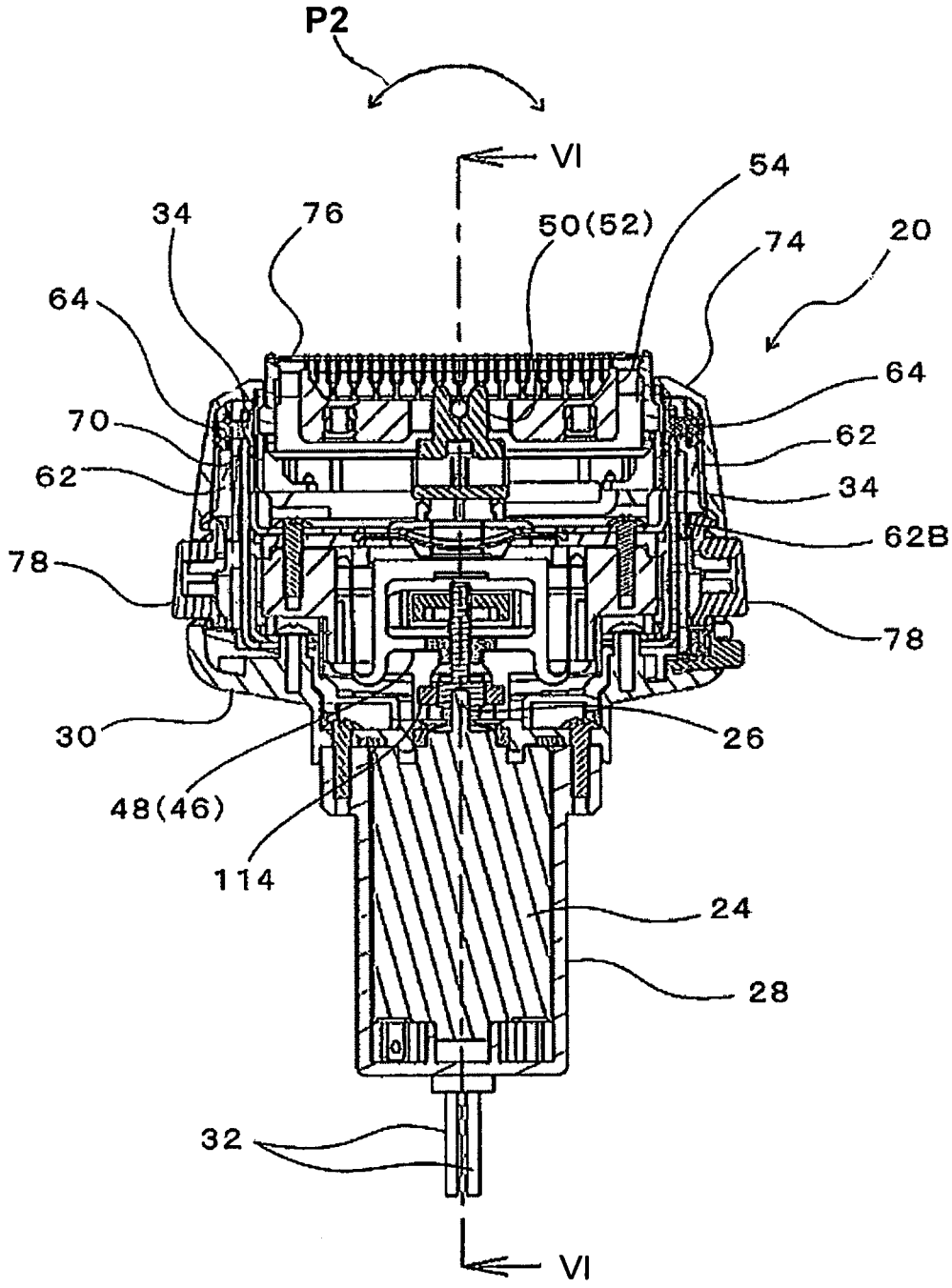
FIG. 5 is a central vertical cross-sectional front view of the shaving unit of the shaver.
Figure 6:
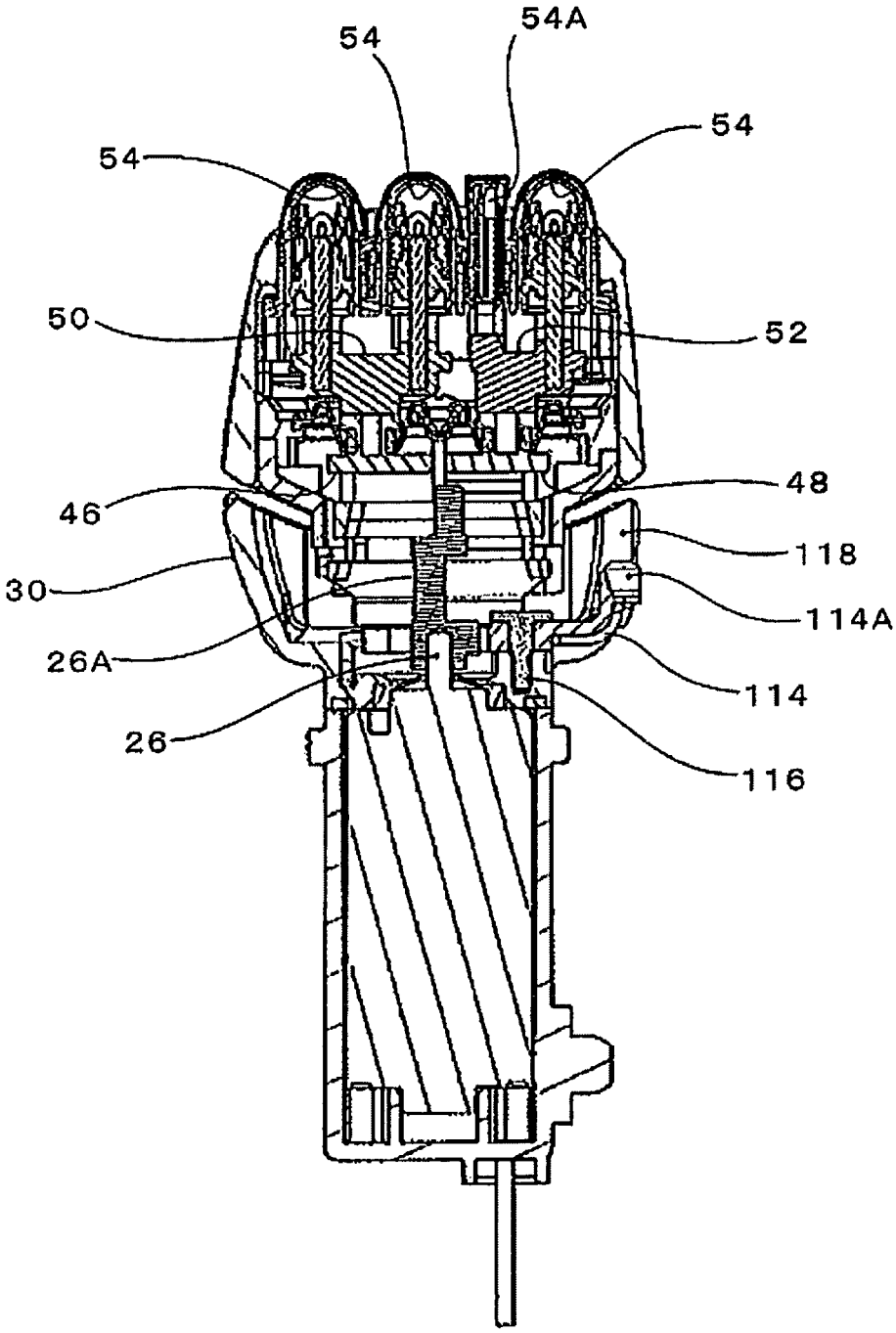
FIG. 6 is a cross-sectional view taken along the line VI-VI in FIG. 5.

The reference numeral 20 is a shaving unit, and this shaving unit 20 is comprised of a head unit 22 and a motor 24 which are of a single unit. The head part 22 includes outer cutters 76, inner cutters 54, and a drive mechanism 44 which will be described below. The motor 24 has a vertically long substantially round pillar shape, and its rotating shaft 26 projects out of the top surface (see FIGS. 4 to 6). The motor 24 is installed in a cylindrical-shaped motor case 28 in which the upper end is open and the lower end is closed. A head bottom plate 30 is fixed to the upper end opening of the motor case 28 with a seal member in between. The rotating shaft 26 projects out of the head bottom plate 30, and a seal member is provided between these elements. Thus, the motor 24 is provided water-tightly by the motor case 28 and the head bottom plate 30. A motor lead line 32 is extended from the bottom surface of the motor case 28. The motor 24 is a single unit including the motor case 28 and the head bottom plate 30; accordingly, the "motor 24" is sometimes meant to include all of these elements in the description below.

Figure 7:
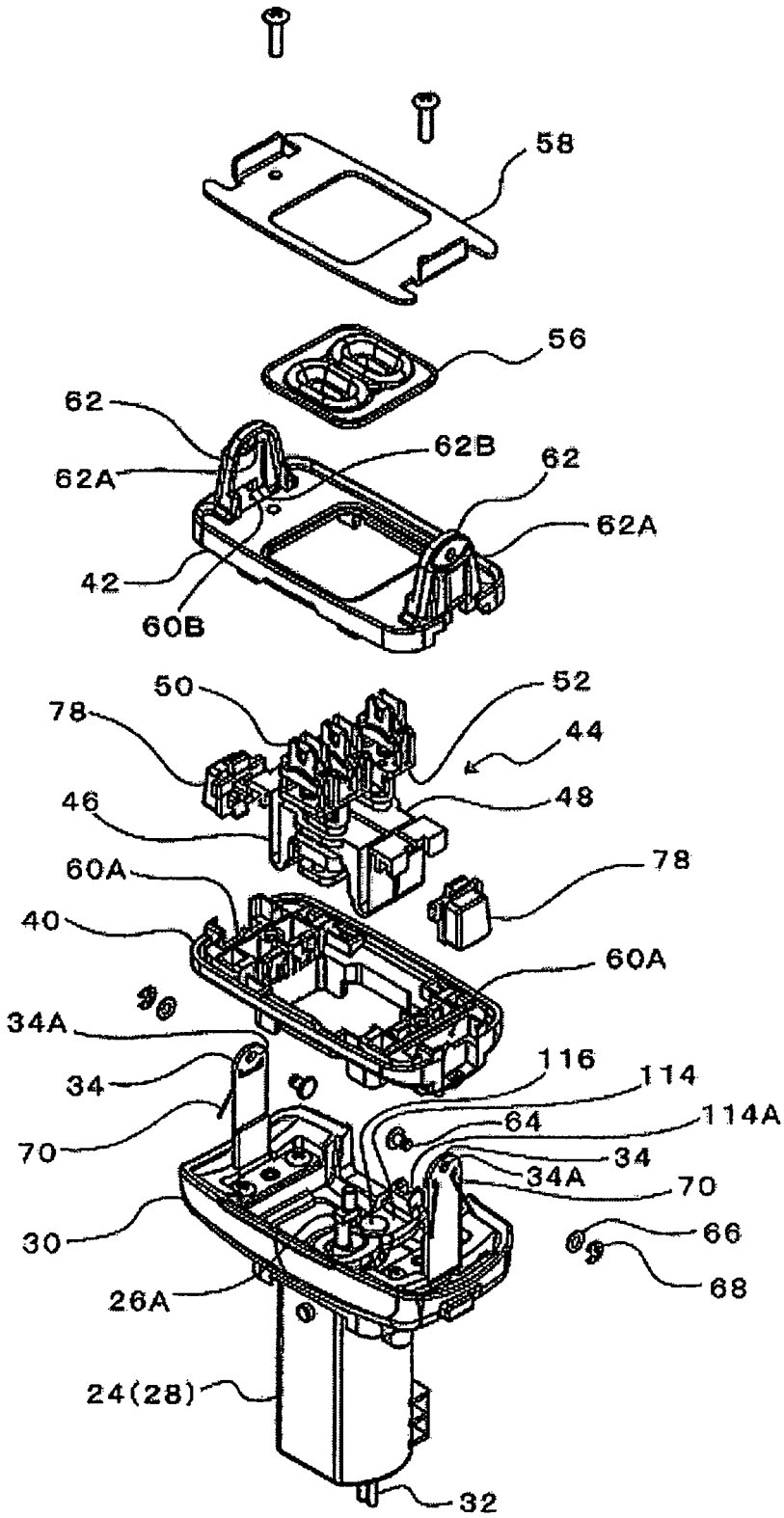
FIG. 7 is an exploded perspective view of the drive mechanism of the shaver.

The head bottom plate 30 has a laterally long, substantially cup shape form; and the inside of the head bottom plate 30 is provided with erected left and right pair of supporting arms 34. As shown in FIG. 7, these supporting arms 34 are leaf springs which have elasticity in the lateral direction (perpendicular to the thickness), and they are urged in the lateral direction outwardly so as to tightly come into contact with tower portions 62 formed in a pivot case 36 that is described below.

The pivot case 36 is, as best seen from FIG. 7, comprised of a pivot case bottom plate 40, of which center portion is open in the vertical direction, and a pivot case upper plate 42, which is provided on the bottom plate 40 so as to make a single unit, and the drive mechanism 44 is held between these two elements. The drive mechanism 44 has two oscillators 46 and 48 of which both left and right ends are held between the pivot case bottom plate 40 and the upper plate 42. The oscillators 46 and 48 are engaged with a crank shaped cam shaft 26A fixed to the rotating shaft 26 of the motor 24, so that the oscillators 46 and 48 are vibrated left and right in mutually opposite phases by the motor 24. On the top surface of the oscillators 46 and 48, inner cutter holders 50 and 52 are provided so as to be moveable vertically, the inner cutter holders 50 and 52 being urged upward by coil springs. These inner cutter holders 50 and 52 respectively hold two inner cutters. Of these totally four inner cutters, three inner cutters 54 are of a semi-cylindrical shape, and the other inner cutter 54A (see FIG. 6) is of an inverted L-shape to make a trimmer for stray beard hairs and is incorporated in the outer cutter 76 that will be described below.

A seal pressing plate 58 is attached to the top surface of the pivot case upper plate 42 with a seal member 56 in between. The seal member 56 makes a liquid tight seal between the opening of the pivot case 36 and the oscillators 46 and 48.

A left/right pair of elongated slots 60 (60A and 60B) are formed in the pivot case 36 (or in the pivot case bottom plate 40 of the pivot case 36) which are long in a front and back direction, and the supporting arms 34 provided on the head bottom plate 30 passes through these slots 60A and 60B. Two tower portions 62 are formed on the pivot case upper plate 42 so as to erect along the edges, in left/right direction outwardly, of the elongated slots 60. With the supporting arms 34 of the head bottom plate 30 brought to enter into the elongated slots 60 (60A and 60B) of the pivot case 36 from below, the pivot case 36 is mounted on the head bottom plate 30. As seen from FIG. 7, two pins 64 are inserted from the inner side into pin holes 34A formed in the supporting arms 34 and further into pin holes 62A formed in the tower portions 62, and a washer 66 and an E ring 68 that prevent the pins 64 from falling out are attached to the tip ends of the pins 64 (the tip ends being on the outside of the pin holes 62A of the pivot case 36). As a result, the pivot case 36 can be moved (pivoted) front and back with the pins 64 as the pivot center as shown by arrow P1 in FIG. 4. In other words, the pins 64 are the front/back pivot center of the head part 22.

On each one of the supporting arm 34, a wire spring 70 is, at a top portion thereof, fixed so as to be below the pin hole 34A, and both ends (leg portions) of the wire spring 70 extend downward. More specifically, the wire spring 70 is bent into a substantially inverted V-shape, both ends (leg portions) of the wire are inserted from the inside into the small holes formed, as a front and back pair, in the supporting arm 34 and extended out of the holds, and these ends (leg portions) are bent downward. The wire spring 70 is made of a spring steel, and thus it is formed in advance to a designated shape (inverted V-shape) and provided on the supporting arm 34 by being inserted into the small holes. The bottom ends of the wire spring 70 are latched to the pivot case 36. In other words, the bottom ends of the leg portions of each one of the wire springs 70 are engaged with step portion 62B (FIG. 7) formed on the inner surface of each one of the tower portions 62 of the pivot case upper plate 42. With this structure, when the front/back pivot motion of the pivot case 36 is made, the bottom end of one of leg portions of the wire springs 70 is compressed by the step portion 62B, and a force that returns the pivot case 36 to its center (vertical) position is generated.

Figure 8:
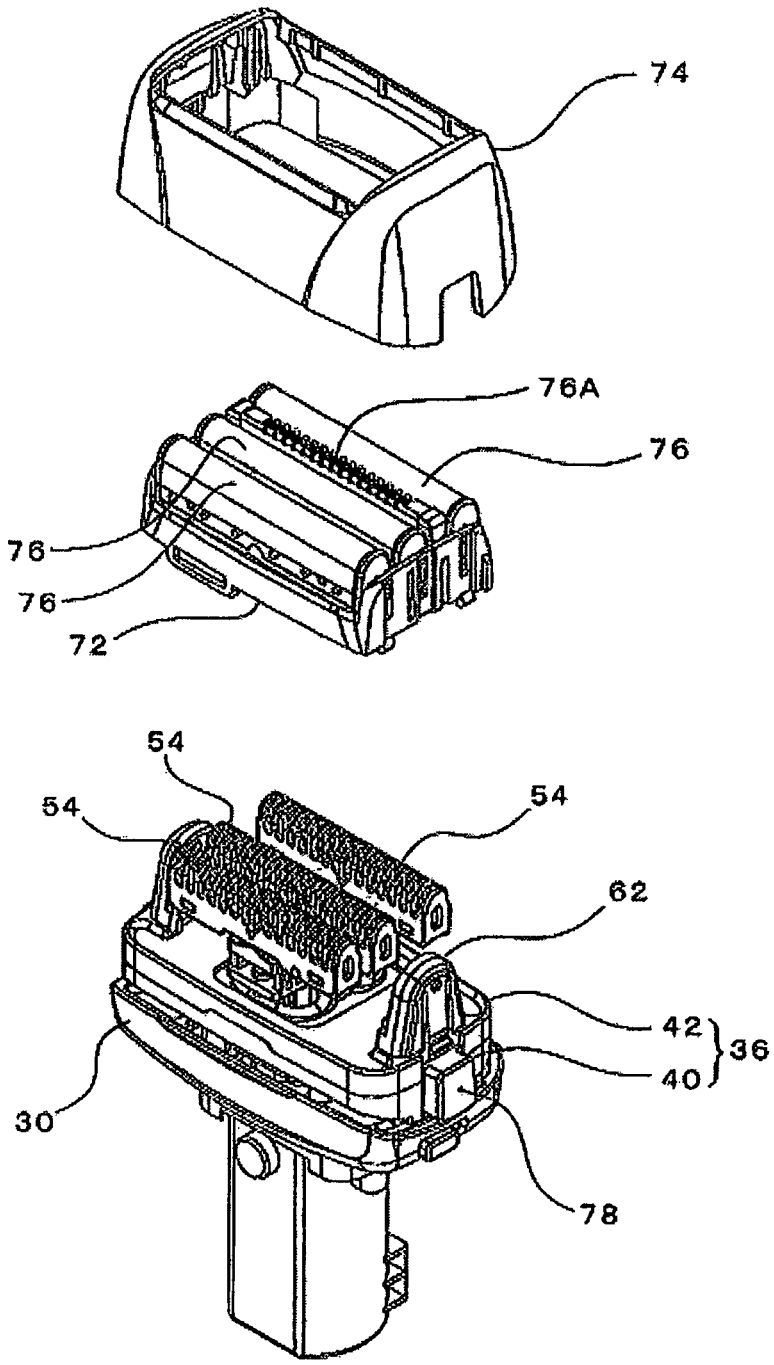
FIG. 8 is an exploded perspective view of the head part of the shaver.

In FIG. 8, the reference numeral 72 is an outer cutter case, and 74 is an outer cutter cover. On the outer cutter case 72, four outer cutters are provided so as to be moveable up and down. Of these outer cutters, three outer cutters 76 are of a normal semi-cylindrical shape, and the remaining one cutter 76A is a trimmer cutter for cutting stray beard hairs. The outer cutter 76A and the adjacent three outer cutters 76 are urged upward by coil springs mounted in the outer cutter case 72.

The outer cutter case 72 is provided together with the outer cutter cover 74 on the pivot case 36 to which the inner cutters 54 are provided. The outer cutter cover 74 is locked by lock buttons 78 provided on the left and right surfaces of the pivot case 36. When the buttons 78 are depressed to unlock, the outer cutter cover 74 is removed.

Figure 4:
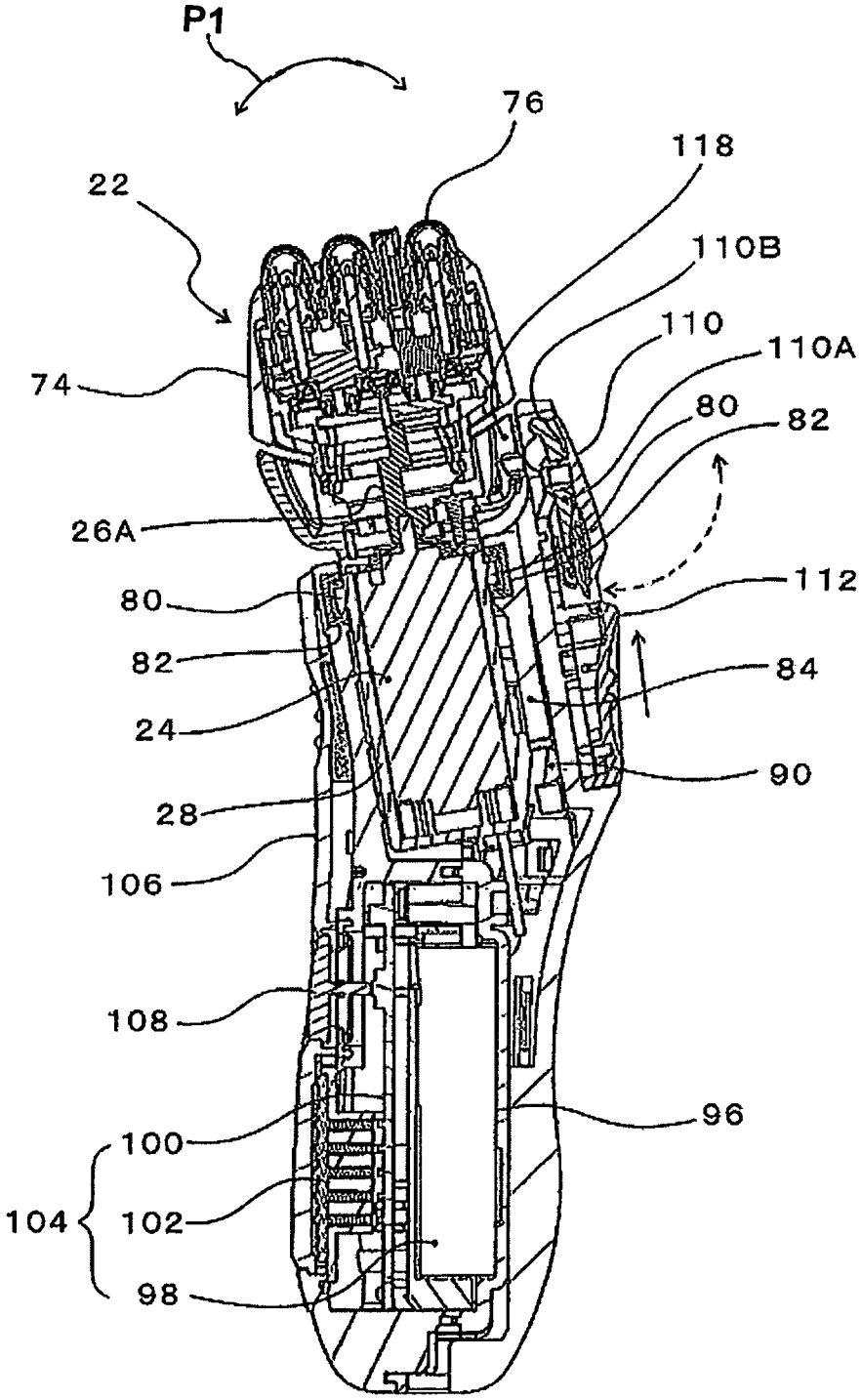
FIG. 4 is a central vertical cross-sectional side view of the shaver.

Next, a structure in which the shaving unit 20 is pivot-supported in the grip section 10 of the shaver will be described. On the top portion of the motor 24 (or of the motor case 28) of the shaving unit 20, projecting parts 80 projecting from the front/back surfaces are formed. These projecting parts 80 are the pivot parts that support the shaving unit 20 to pivot in a left and right directions (sideways). The projecting parts 80 are covered by anti-vibration rubbers 82 (FIG. 4). On the inner surface of the front casing 12 of the grip section 10, a concave portion is formed so that the projecting part 80 formed on the front surface of the motor 24 (or of the motor case 28) and the anti-vibration rubber 82 are engaged therewith.

The reference numeral 84 is a motor holder. As seen from FIG. 2, the motor holder 84 is mounted on the back surface of the motor 24 (or of the motor case 28), and its top portion covers the projecting part (pivot part) 80 of the back surface of the motor 24 (or of the motor case 28). A concave portion with which the projecting part 80 on the motor 24 (motor case 28) back surface and the anti-vibration rubber 82 are engaged is provided in the motor holder 84. As shown in FIG. 2, this motor holder 84 straddles the top portion of the motor 24 and is temporarily held by the front casing 12 of the grip section 10 of the shaver. In other words, boss portions 86 into which screws for fixing the back casing 24 to the front casing 12 are formed on the front casing 12, and semi-cylindrical shaped concave portions 88 with which the boss portions 86 of the front casing 12 are engaged are formed on the motor holder 84.

Accordingly, while making a positioning-mating of the front projecting part 80 of the motor 24 (motor case 28) with the concave portion of the front casing 12 and making a positioning-mating of the back projecting part 80 of the motor 24 (motor case 28) with the concave portion of the motor holder 84, the semi-cylindrical shaped concave portions 88 of the motor holder 84 are engaged with the boss portions 86 of the front casing 12, thus temporarily holding the motor holder 84 on the front casing 12.

On the back surface of the motor case 28 is formed a projecting piece 90 so as to be below the projecting part 80 which is the pivot part. On the other hand, a substantially horizontal elongated window 92 into which the projecting piece 90 enters is formed in the motor holder 84. Thus, with the motor holder 84 being mounted on the motor 24 (or on the motor case 28), two coil springs 94 are compression-mounted inside the elongated window 92 so that these springs 94 sandwich the projecting piece 90 from both the left and right sides. These coil springs 94, while making it possible for the shaving unit 20 to pivot left and right as shown by arrow P2 in FIG. 5, impart a force that returns the shaving unit 20 to its erect (vertical) position (center position).

In FIGS. 3 and 4, the reference numeral 96 is an inner cover, and this is attached to the bottom portion of the front casing 12. A power supply unit 104 that includes a battery 98 (FIG. 4), a wiring substrate 100, a warning display light 102 and the like is housed in a water-tight fashion between this inner cover 96 and the front casing 12. As is clear from FIGS. 1 and 4, a decorative plate 106 is attached to the front surface of the front casing 12. A power switch 108 is attached to this decorative plate 106. A translucent coating is applied on the part that covers the warning display light 102 at the bottom portion of this decorative plate 106, so that the charge warning display of the warning display light 102 is visible from the outside.

After attaching the inner cover 96 which waterproofs the power supply unit 104, the motor lead line 32 of the motor 24 is connected to the power supply unit 104 with sufficient length allowed. Then, the back casing 14 is mated to the front casing 12 and then fixed thereto using six screws. When the front and back casings are fixed together, the motor holder 84 is fixed by the screws that are used for fixing the back casing 14 to the front casing 12.

On this back casing 14 is provided an edge trimming cutter 110 so that it can flip up and down. As seen from FIG. 4, this edge trimming cutter 110 opens, as indicated by a curved tow-headed arrow, to the outside about its top portion when the operating element 112 that moves up and down is slid in the upward direction as indicated by a straight arrow. When the edge trimming cutter 110 opens, a vibration cutter 110A (FIG. 4) of the edge trimming cutter 110 is engaged with a drive lever 114 (see FIGS. 4 and 6). More specifically, the drive lever 114 is held by a support pin 116 which is perpendicular to the head bottom plate 30 at the back of the rotation shaft 26 of the motor 24, and that front end (one end of the rotation shaft 26) is engaged with the cam of the crank shaped cam shaft 26A, and the back end faces a notch 118 provided at the back edge of the head bottom plate 30. A concave portion 114A that opens upward and downward is formed on the back end of the drive lever 114; and when the edge trimming cutter 110 is opened, a sphere shaped engaging part 110B provided at the top edge (FIG. 4) of the vibration cutter 110A engages with this concave portion 114A.

Accordingly, when motor 24 is activated, the drive lever 114 is vibrated about the support pin 116, and thus the vibration cutter 110A of the edge trimming cutter 110 makes reciprocating vibrations. If the edge trimming cutter 110 is housed back, the engaging part 110B of the vibration cutter 110A is brought out of the concave portion 114A of the drive lever 114, and the vibration cutter 110A is stopped.

As seen from the above, in the present invention, the motor 24 of the shaving unit 20 is inserted from above into the grip section 10 of the shaver, and in a state that the shaving unit 20 is pivot-supported by the front casing 12 and the motor holder 84, the back casing 14 is fixed to the front casing 12. The covers 16 (FIG. 1) are then fitted to the left and right side surfaces of the grip section 10.

If the electric shaver of the present invention as described above is moved to the left and right while the outer cutters 76 being pressed against the skin during shaving, the shaving unit 20 pivots to the left and right using the projecting parts 80, which are the pivot part, as the pivot center. In addition, if the shaver is moved up and down and front and back, the head part 22 is pivoted up and down and front and back. Accordingly, the outer cutters 76 can be moved while making close contact with the skin, and a smooth shaving can be performed. In the present invention, the return force with respect to the left and right direction pivot motion and the return force with respect to the front and back and up and down direction pivot motion can be set independently from each other by the separate, different springs, that is, by the coil springs 94 and by the wire springs 70; accordingly, the freedom for setting the return force of the head part is increased.

The invention claimed is:

1. A reciprocating electric shaver including a shaving unit in which a substantially semi-cylindrical, horizontal outer cutter, an inner cutter that makes sliding contact with an inner surface of the outer cutter, a motor, and a drive mechanism that reciprocates the inner cutter using said motor are formed into a single unit, with said shaving unit being pivotable in a left direction and in a right direction, wherein said shaving unit is supported in a grip section of said shaver by a front pivot part and a back pivot part that sandwich said motor from a front direction and a back direction, a head part that includes said outer cutter and inner cutter and said drive mechanism is provided so as to pivot in the front direction and in the back direction with respect to said motor, said grip section comprises a motor holder formed with a horizontal elongated window below the pivot parts, a projecting piece provided on said motor enters said elongated window so as to be moveable in the left direction and in the right direction, coil springs are provided in said elongated window so as to sandwich said projecting piece from both left and right sides of the projecting piece and so as to return the shaving unit to a return position thereof in the left direction and the right direction, and said projecting piece is provided on a back surface of the motor.

2. A reciprocating electric shaver including a shaving unit in which a substantially semi-cylindrical, horizontal outer cutter, an inner cutter that makes sliding contact with an inner surface of the outer cutter, a motor, and a drive mechanism that reciprocates the inner cutter using said motor are formed into a single unit, with said shaving unit being pivotable in a left direction and in a right direction, wherein:

said shaving unit is supported in a grip section of said shaver by a front pivot part and a back pivot part that sandwich said motor from a front direction and from a back direction, a head part that includes said outer cutter and inner cutter and said drive mechanism is provided so as to pivot in the front direction and in the back direction with respect to said motor, wherein said head part includes a pivot case that pivots in the front direction and in the back direction with respect to the motor, said motor is installed in a motor case, said pivot case is held, so as to pivot in the front direction and in the back direction, by a left supporting arm and a right supporting arm which are erected from said motor case, said supporting arms hold a left tower portion and a right tower portion erected on the pivot case so that the tower portions are pivotable in the front direction and in the back direction, each of said supporting arms is urged in a direction elastically brought into contact with each of said tower portions.

3. A reciprocating electric shaver including a shaving unit in which a substantially semi-cylindrical, horizontal outer cutter, an inner cutter that makes sliding contact with an inner surface of the outer cutter, a motor, and a drive mechanism that reciprocates the inner cutter using said motor are formed into a single unit, with said shaving unit being pivotable in a left direction and in a right direction, wherein said shaving unit is supported in a grip section of said shaver by a front pivot part and a back pivot part that sandwich said motor from a front direction and a back direction, a head part that includes said outer cutter and inner cutter and said drive mechanism is provided so as to pivot in the front direction and in the back direction with respect to said motor, said grip section comprises a motor holder formed with a horizontal elongated window below the pivot parts, a projecting piece provided on said motor enters said elongated window so as to be moveable in the left direction and in the right direction, coil springs are provided in said elongated window so as to sandwich said projecting piece from both left and right sides of the projecting piece and so as to return the shaving unit to a return position thereof in the left direction and the right direction, said head part includes a pivot case that pivots in the front direction and in the back direction with respect to the motor, said drive mechanism is provided in said pivot case, said pivot case holds therein an outer cutter case that holds the outer cutter so as to be moveable in an upward direction and in a downward direction, and an inner cutter holder that holds, while urging in the upward direction, the inner cutter, said motor is installed in a motor case, said pivot case is held, so as to pivot in the front direction and in the back direction, by a left supporting arm and a right supporting arm that are erected from said motor case, said supporting arms are provided with wire springs that are fixed at top portions thereof to said supporting arms, said wire springs are engaged at bottom portions thereof with said pivot case so as to return the pivot case to a return position thereof, and each of said wire springs is bent into a substantially inverted V-shape so that both end portions thereof are passed through a front hole and a back hole formed in each one of the supporting arms and then bent downward and engaged with said pivot case.

* * * * *